US006187698B1

(12) United States Patent
Muller

(10) Patent No.: US 6,187,698 B1
(45) Date of Patent: Feb. 13, 2001

(54) THERMOSETTING RESIN BONDED SHAPED ELEMENTS

(75) Inventor: Franz-Josef Muller, Iserlohn (DE)

(73) Assignee: Bakelite AG (DE)

( * ) Notice: Under 35 U.S.C. 154(b), the term of this patent shall be extended for 0 days.

(21) Appl. No.: 09/040,846

(22) Filed: Mar. 18, 1998

(30) Foreign Application Priority Data

Mar. 25, 1997 (DE) ..... 197 12 509

(51) Int. Cl.[7] ..... D04H 1/08

(52) U.S. Cl. ..... 442/320; 442/321; 442/324; 442/FOR 156; 442/FOR 162; 442/FOR 164

(58) Field of Search ..... 442/320, 321, 442/324, FOR 156, FOR 162, FOR 164

(56) References Cited

U.S. PATENT DOCUMENTS 4,745,024 * 5/1988 Jellinek et al. ..... 428/288

* cited by examiner

*Primary Examiner*—Helen L. Pezzuto
(74) *Attorney, Agent, or Firm*—Bierman, Muserlian and Lucas

(57) ABSTRACT

Fibrous shaped elements bonded with thermosetting resins comprising a plurality of fiber layers with at least two different thermosetting resins, preferably with inner fiber layers comprising phenolic resins as the bonding agent and the upper and lower outer layers comprising epoxide resins as the bonding agent.

9 Claims, No Drawings

THERMOSETTING RESIN BONDED SHAPED ELEMENTS

STATE OF THE ART

Shaped parts produced of fibers, such as are used for example in automobile manufacturing as climate-regulating sound-absorbing parts and shaped parts with high surface and shatter strength are conventionally produced by compression molding and simultaneous curing of phenolic resin-bonded fiber layers (formed fabrics). These products have the disadvantage that they occasionally, especially when they are exposed to the effects of increased temperatures and humidity, produce a disturbing odor which is largely due to the curing agent (hexamethylene tetramine) and its amine decomposition products.

According to EP-A 0 254,807, this problem is solved by using a powder-form mixture as the bonding agent comprising a phenolic resin which is nonthermo-reactive and one or more condensation products from the group of phenolic resins, amino resins or epoxide resins. Although the odor formation due to hexamethylene tetramine can thereby be avoided, a residual odor from the phenolic resin remains.

OBJECTS OF THE INVENTION

It is an object of the invention to provide shaped fibrous elements with a thermosetting resin as the bonding agent which maintain good mechanical, sound-absorption and incombustible properties of phenolic resin bonded fibrous shaped elements free of any odor development of the phenolic resins.

It is another object of the invention to provide a method to produce shaped fibrous elements having increased strength with a weight reduction of the motor vehicle components without any quality loss.

These and other objects and advantages of the invention will become obvious from the following detailed description.

THE INVENTION

The fibrous shaped elements of the invention are comprised of at least two fiber layers using different thermosetting resin bonding agents. Preferably, the shaped elements are comprised of at least one inner fiber layer with a phenolic resin bonding agent and at least one upper covering fiber layer and lower covering fiber layer bonded with an epoxide resin agent.

The thermosetting resin bonding agents may be self-curing resins or may be provided with a curing agent or curing catalyst which are cured to form a high polymer product at an elevated specific temperature. Examples of suitable thermosetting resins are diallylphthalate resins, epoxide resins, urea resins, melamine resins, melamine-urea resins, melamine-phenolic resins, phenolic resins and mixtures thereof. The preferred resins are based on phenolic resins and epoxide resins.

It is surprising that the fibrous shaped elements produced by the invention do not develop an odor of phenolic resin or amine degradation products of hexamethylene tetramine although the individual thermosetting resin bonded fiber layers, and thus also the entire fibrous shaped elements are permeable to air and gas. It is a further unexpected advantage of these fibrous shaped elements that they exhibit increased strength so that it becomes possible to achieve the same strength with thinner fibrous shaped elements of the invention as can be attained with conventional, heavy fibrous shaped elements only bonded with phenolic resin. In particular, a further increase in strength and a decrease of the odor emissions is attained if the fiber layers provided with the thermosetting resin bonding agents are produced according to a carding process.

Examples of phenolic bonding agents are all condensation products of phenols and aldehydes, especially phenol, cresol or xylenol with formaldehyde, more preferably resols and conventional novolac, most preferably mixtures of novolac and hexamethylene tetramine. Usually, the phenolic resins are used in the form of powders.

The bonding agents based on epoxide resins are usually a powder mixture of epoxide compounds with at least two epoxy groups per molecule and a curing agent. Latent curing agents are preferred to obtain sufficient processing time between the time of mixing and of curing. Examples of latent curing agents are acid anhydrides or imidazole derivatives but preferred are novolacs or metal complex compounds such as described in EP-B 0,518,908.

Examples of fibers are inorganic fibers such as glass fibers and organic fiber-like materials or any fiber mixtures. Preferred are organic fibers such as wool, cotton, staple fibers, jute, flax, hemp, polyester or acrylic fibers. A large portion of the fiber material used may be obtained from discarded textile materials by way of a reclamation process which fibers are mixed by methods known per se with the particular bonding agents and placed into discrete fiber layers (formed fabrics, in particular carded formed fabrics).

According to the invention, several fiber layers (formed fabric webs) with at least two different thermosetting resin bonding agents are placed one on top of the other. Preferably there are used one or several fiber layers together with phenolic resin as the bonding agent as the inner layer and its upper side and bottom side each are provided with a covering layer comprising one or several fiber layers comprising epoxide resin as the bonding agent.

The individual fiber layers or the stacked structure (intermediate products) are cut to size in a manner known per se and can be either precured and cured at a later time while being shaped, or the stacked structures are immediately cured as sheets at temperatures above the curing temperatures of the thermosetting resin bonding agents. In the simplest case, fibrous formed fabrics are combined with, in each instance, different bonding agents as semifinished products and are molded and cured at a temperature above the curing temperature of the thermosetting resin bonding agents potentially while being shaped. For example, a hat rack with a weight per unit area of 2500 g/m$^2$ may be fabricated from two semifinished products each weighing 500 g/m$^2$ with an epoxide resin-curing agent mixtures as the bonding agent and an interspaced semifinished product weighing 1500 g/m$^2$ with novolac-hexamethylene tetramine as the bonding agent.

The preferred method of the invention for the production of the thermosetting resin bonded fiber layers is the carding process in which the fibers are combed out to extremely fine piles which then are provided with bonding agents and are stacked in longitudinal and transverse position until the desired weight per unit area is obtained with the upper covering layer, middle layer and lower layer comprising different bonding agents, if desired. The middle layers preferably comprise also phenolic resins and the upper and lower outer layers epoxide resins as the bonding agent.

In a particularly preferred method, fibrous formed fabrics (fiber layers) are produced by the carding process such that over the continuously produced fibre felt are sprinkled in the longitudinal direction over three equally or differently wide zones different bonding agents whereby the inner zone contains the bonding agent for the inner layer of the fibrous shaped element and the two outer zones contain the bonding agent(s) for the upper and lower outer layer of the fibrous shaped element. The formed fibre felt produced in this way is arranged in a cross-folding technique such that the newly formed fibre felt comprises fiber layers with different bonding agents.

This formed fibre felt is briefly heated such that the thermosetting resin bonding agents melt and are fixed on the fiber, but are not cured. The formed fibre felt is then cooled and fitted. Lastly, the intermediate products produced in this way, potentially while being shaped, are molded and cured in a manner known per se and for this purpose several of these semifinished products can also be placed one above the other and molded together and cured.

In the following example, there is described a preferred embodiment to illustrate the invention. However, it is to be understood that the invention is not intended to be limited to the specific embodiment.

EXAMPLE

The phenolic resin bonding agent used was a phenol novolac with a softening point of 98° C. mixed with 6 wt % of hexamethylene tetramine and, the epoxide resin bonding agent used was a mixture of an epoxide resin based on bisphenol A (epoxide equivalent: 183; softening point: 75° C.) and 5 wt % of a latent curing agent comprising a pulverized "solid solution" of 30% 2-methyl-imidazole in 70% of a phenol novolac having a high melting point.

Using the carding process, a fibrous formed fabric comprising a textile fiber mixture and powder resin bonding agents was produced continuously. Over the fibrous formed fibre felt, the different bonding agents were sprinkled in the longitudinal direction over three zones of equal widths. The two outer zones received the epoxide resin bonding agent and the inner zone received the phenolic resin bonding agent. The formed fibre felt produced in this way was arranged in a cross-folding technique known per se so that a new formed fibre felt was formed in which the inner layer comprised the phenolic resin and the upper and the lower outer layer comprised the epoxide resin as the bonding agent.

The said formed fibre felt was conducted through a circulating air oven kept at 150° C. at such a rate that the bonding agents melted and became fixed on the fibers but were not cured. The web was then cooled, fitted and then, while being shaped, molded for 60 seconds at 180–190° C. and 170 bars and cured. The thermosetting resin bonded fibrous shaped element was self-extinguishing and, when exposed to external flames, had a low smoke density. The fibrous shaped element was free of odors, even under the effect of increased temperatures (40–70° C.) and humidity (90% relative ambient humidity). Compared to a fibrous shaped element bonded only with phenolic resins of the same weight per unit area, it possessed a strength which was increased by 27% and no separation phenomena of individual layers, the so-called splitting, were observed.

Various modifications of the elements and method of the invention may be made without departing from the spirit or scope thereof and it is to be understood that the invention is intended to be limited only as defined in the appended claims.

What I claim is:

1. A fiber shaped element comprising at least two thermosetting binder bound fiber layers, and at least two fiber layers containing a different thermosetting binder.

2. A fiber shaped element of claim 1 comprising two fiber layers wherein one thermosetting binder is a phenolic binder agent and the other thermosetting binder agent is an epoxide binder.

3. A fiber shaped element of claim 1 wherein the fiber layers are produced by the carding process.

4. A fiber shaped element comprising at least one inner fiber layer with a phenolic binder and at least one upper and one lower outer layer with an epoxide binder.

5. A fiber shaped element of claim 4 wherein the fiber layers are produced by the carding process.

6. A process for the preparation of a fiber shaped element of claim 1 comprising combining at least two thermosetting binder bound fiber layers, the at least two layers containing a different thermosetting binder and curing the combined fiber layers at a temperature above the curing temperature of the different thermosetting binders.

7. The process of claim 6 wherein the fiber layers are produced by the carding method.

8. A process for the preparation of a fiber shaped element of claim 4 providing at least one inner fiber layer with a phenolic binder with at least one outer upper and outer lower fiber layer with an epoxide binder and curing the element at a temperature higher than the curing temperature of the binder agents.

9. A process for the preparation of a fiber shaped element of claim 4 comprising forming fiber layers by the carding process, sprinkling the resulting fiber web over three longitudinal zones with an inner zone receiving powdered phenolic binder and the two outer zones receiving powdered epoxide binder, subjecting the coated fiber felt to cross-folding to form a fiber web with an inner fiber layer with a phenolic binder and an outer upper and an outer lower fiber layer with an epoxide binder, briefly heating the formed fiber felt to melt the binders without curing, carding and fitting the fiber felt and shaping, molding and curing the fiber felt.

* * * * *